United States Patent [19]

Smejkal et al.

[11] 4,198,035

[45] Apr. 15, 1980

[54] BLOWING LANCE MEDIA-SUPPLY ARRANGEMENT

[75] Inventors: Hellmuth Smejkal, Linz; Ernst Zajicek, Ottensheim, both of Austria

[73] Assignee: Voest-Alpine Aktiengesellschaft, Linz, Austria

[21] Appl. No.: 939,680

[22] Filed: Sep. 5, 1978

[30] Foreign Application Priority Data

Oct. 11, 1977 [AT] Austria ..... 7244/77

[51] Int. Cl.[2] ..... C21C 7/00

[52] U.S. Cl. ..... 266/226; 75/60; 266/225

[58] Field of Search ..... 266/225, 226; 75/60

[56] References Cited

U.S. PATENT DOCUMENTS

| | | | |
|---|---|---|---|
| 3,149,191 | 9/1964 | McFeathers | 266/226 |
| 3,276,759 | 10/1966 | Kardos | 266/226 |
| 3,412,989 | 11/1968 | Penn | 266/226 |
| 3,438,820 | 4/1969 | Goss | 75/60 |

*Primary Examiner*—P. D. Rosenberg
*Attorney, Agent, or Firm*—Brumbaugh, Graves, Donohue & Raymond

[57] ABSTRACT

In a blowing lance media-supply arrangement for a metallurgical vessel, a carrying car is displaceable into and out of a blowing position along a moving path and includes at least one blowing lance. Media supply conduits lead to the blowing position of the carrying car and are connected to a stationary joining piece arranged there. A joining counter piece corresponding to the joining piece is mounted to the carrying car, and the joining piece and the joining counter piece are connectable in a conduit-like manner.

8 Claims, 4 Drawing Figures

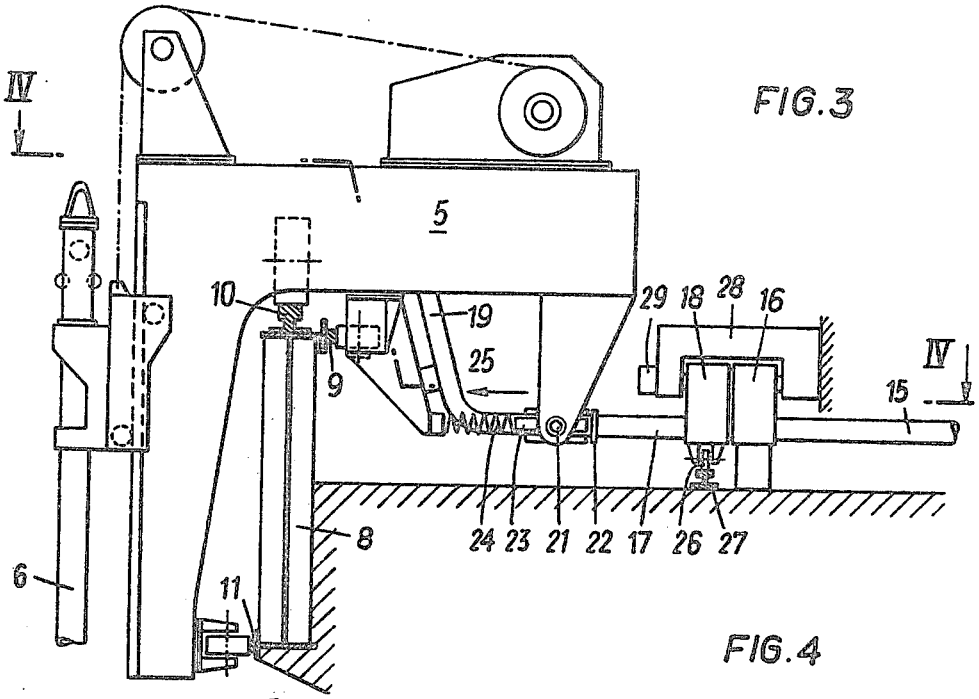
FIG. 3
FIG. 4
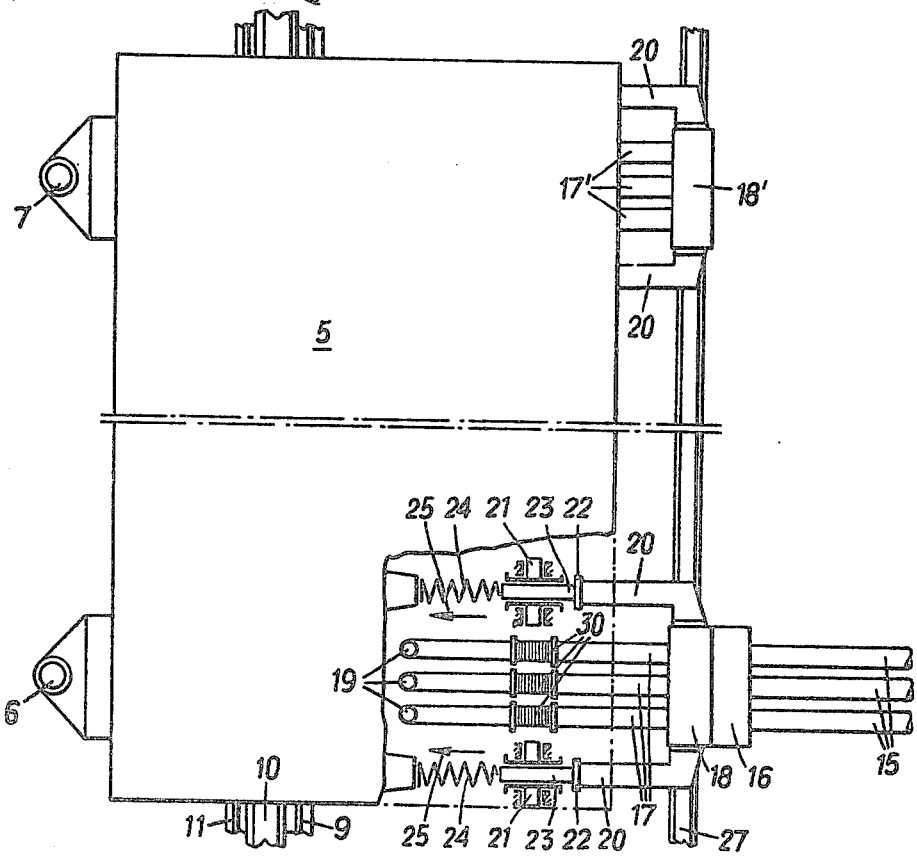

BLOWING LANCE MEDIA-SUPPLY ARRANGEMENT

BACKGROUND OF THE INVENTION

The invention relates to an arrangement for supplying media to a blowing lance for a metallurgical vessel, in particular a converter to be used in a steel making plant, wherein the blowing lance is arranged on a carrying car that is displaceable into and out of the blowing position.

For supplying blowing lances with media, such as oxygen, cooling water and, if desired, fuels and additives, it has been known to connect a displaceable carrying car to the supply conduits for those media by means of tubes or hoses. In the carrying car itself, a conduit system separating from the tubes and formed by other flexible tubes or articulate pipes is arranged. This car conduit system leads to the blowing lance which is liftable and lowerable relative to the carrying car.

The moving path of the carrying car is delimited by the length of the tubes. If the carrying car is in the vicinity of the supply conduits, the tubes will hang down considerably, thus requiring a limit on the length of the tubes and the moving path of the carrying car. On each displacement of the carrying car, a bending stress is exerted on the tubes, thus restricting the service life and operational safety of the tubes. A further disadvantage of the known arrangement is to be seen in that, due to the carrying car being bound to a certain area, a special carrying car has to be provided for every converter.

SUMMARY OF THE INVENTION

The invention aims at avoiding these disadvantages and difficulties and has as its object to provide an arrangement of the initially-defined kind in which the carrying car is displaceable along its moving path for any desired distance without being impeded by the tube conduits, so that it can be employed for at least two converters. A further object of the invention involves making the media supply conduit leading to the carrying car operationally safer.

These objects are achieved according to the invention in that a joining piece connected to a media supply conduit is stationarily arranged on the moving path of the carrying car which can be moved into the blowing position, a corresponding joining counter piece mounted on the carrying car being connectable with the same in a conduit-like manner.

In order to achieve a safe sealing connection of the stationary media supply conduit to that arranged in the carrying car, each joining counter piece is advantageously fastened to the carrying car with moving play and is pressable to the corresponding stationary joining piece by means of a clamping device.

According to a preferred embodiment, in case of a plurality of media supply conduits, the stationary joining pieces are commonly mounted to a joining plate and the corresponding joining counter pieces are commonly mounted to a counter joining plate.

In this case, the joining counter plate is suitably arranged parallel to the moving direction of the carrying car and is hinged to the carrying car by means of an articulation lever so as to be pivotable about a pin arranged in the moving direction of the carrying car, whereby the joining counter plate can be brought exactly into the joining position opposite the stationary joining plate.

In this case, the joining counter plate is suitably arranged on the carrying car so as to be displaceable parallel to the moving direction of the carrying car, so that it is possible to press the joining counter plate against the stationary joining plate.

This purpose is advantageously served by a coupling piece mounted to the stationary joining plate, which piece overlaps the joining counter plate of the carrying car which is moved into the blowing position and comprises a pressure medium cylinder that engages on the joining counter plate.

It is advantageous, if the joining counter plate is provided with at least one supporting wheel which is supported on a rail arranged parallel to the moving path of the carrying car. By this wheel, the joining counter plate is continuously held in the right position relative to the joining plate, independently of the inherent movements of the carrying car.

According to a suitable embodiment of the invention, media supply conduits lead to each converter in a hall where at least two converters are provided. The stationary joining pieces of the converters are selectively connectable to a carrying car that is displaceable between those joining pieces.

BRIEF DESCRIPTION OF THE DRAWINGS

The invention will now be described in more detail by way of one embodiment and with reference to the accompanying drawings, wherein:

FIG. 3 is a schematic representation of a side view of the carrying car of FIG. 2 in the direction of the arrow III of FIG. 2; and FIG. 4 is a plan view of FIG. 3 on an enlarged scale, partly sectioned along line IV—IV.

DESCRIPTION OF A PREFERRED EMBODIMENT

Figure 1:
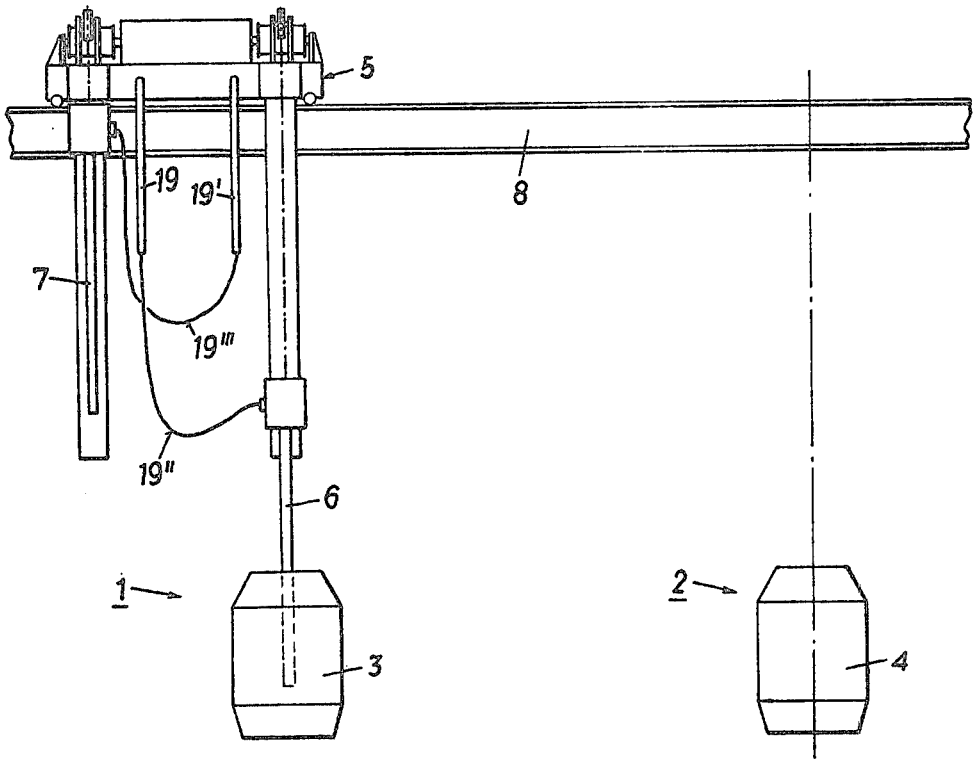
FIG. 1 is a schematic representation of a side view of two adjacently arranged blowing stands of a converter.

In FIG. 1, two adjacently arranged blowing stands are denoted by 1 and 2, which stands include converters 3 and 4. Above the converters is a carrying car 5 which is equipped with two blowing lances 6 and 7, blowing lance 6 being the working lance and blowing lance 7 being the spare lance for use in case of damage to the former. The car 5 is displaceable along rails 9, 10 and 11 mounted on a carrier 8. Parallel to the rails, stationary media supply conduits 12, 13 and 14, and 12', 13' and 14', respectively, are laid for each blowing stand for supplying oxygen, and for supplying and conducting-away a cooling agent. Further media conduits may be provided, e.g. for a heating gas or for additives. At each blowing stand, stationary joining pieces 15 are arranged for each of the conduits, which joining pieces are commonly mounted in a joining plate 16. The carrying car 5, on which each of the blowing lances 6, 7 are liftably and lowerably mounted, comprises joining counter pieces 17, 17' which correspond to the stationary joining pieces 15 and are commonly mounted in a joining counter plate 18, 18'. From the joining counter plate pipe conduits 19, 19' and hose conduits 19'', 19''' for the above-mentioned media lead to the blowing lances 6, 7.

Figure 2:
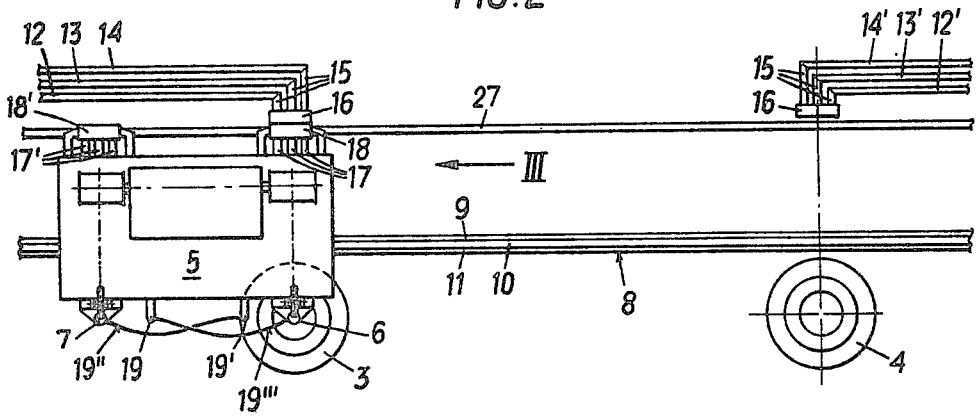
FIG. 2 is a plan view of FIG. 1.

As can be seen from FIG. 2, the joining counter plate of the blowing lance is connectable to the stationary joining plate which is arranged above the converter.

The openings of the media supply conduits which are not connected to the carrying car and the openings of the nonconnected conduits within the carrying car, are closeable by dust protection caps (not illustrated), either manually or by means of remote control. The joining counter plates 18, 18' provided at the carrying car are pivotable, with articulation levers 20 at the carrying car, 5 about articulation pins 21 which are arranged in the moving direction of the carrying car (FIGS. 3 and 4). In the plane that is perpendicular to the moving direction, each joining counter plate is displaceable along the articulation levers 20 penetrating the articulation pins 21, as far as a stop 22 provided at the articulation levers. The end 23 of the articulation levers projecting beyond the articulation pins 21 is fastened to the carrying car 5 by intercalation of a retracting spring 24 acting in the direction of the arrow 25. The media conduits 19 leading from the joining counter pieces of the carrying car to the blowing lances, comprise compensators, i.e. folding bellows 30 of metal or synthetic material, etc., which enable the pivot and displacement movements of the joining counter plates 18, 18' relative to the carrying car 5.

At the lower side of each joining counter plate 18, 18', a flangeless supporting wheel 26 is mounted, which wheel turns on a rail 27 arranged parallel to the rails 9, 10, 11 of the carrying car 5, thus holding each joining counter plate 18, 18' at the right height relative to the stationary joining plates 16.

Each stationary joining plate 16 is provided with a clamp-like coupling piece 28 which overlaps the joining counter plate fastened to the carrying car when the blowing lance is in the blowing position. The end of the coupling piece 28 overlapping the joining counter plate 18 of the carrying car is equipped with a hydraulically activated piston 29 which, during charging, sealingly presses the joining counter plate 18 mounted to the carrying car towards the stationary joining plate 16, against the action of the springs 24, whereby the media supply conduits are connected to the blowing lance arranged above the converter.

By the arrangement according to the invention, it is possible to rely on only one carrying car 5 for both converters 3 and 4, only one of which is in operation at a time. In a converter plant with, for instance, three converters, from which two are in operation each time and one is charged, two carrying cars will suffice according to the invention. The media supply conduits of the converter not in operation are locked at a valve stand that is not illustrated. It is, however, also possible to provide common media supply conduits for all blowing stands, which comprise lockable joining pieces at each blowing stand.

What we claim is:

1. In a blowing lance media-supply arrangement for at least one metallurgical vessel of the type including a carrying car displaceable into and out of at least one blowing position along its path of movement, and at least one blowing lance arranged on said carrying car, the improvement comprising:

media supply conduit means;

a stationary joining piece connected to said media-supply conduit means and arranged along said path of said carrying car at its at least one blowing position; and a joining counter piece mounted to and movable with said carrying car and being connected to said blowing lance by a pipe conduit means, said counter joining piece corresponding to said joining piece such that they are connectable together in such a manner as to establish a conduit from said media-supply conduit means when said car is in the blowing position.

2. A blowing lance media-supply arrangement as set forth in claim 1, further comprising clamping means, and wherein said joining counter piece is fastened to said carrying car with play and is adapted to be pressed to said joining piece by said clamping means.

3. A blowing lance media-supply arrangement as set forth in claim 1, comprising a plurality of media-supply conduits, a plurality of stationary joining pieces and a plurality of corresponding joining counter pieces, and wherein a stationary joining plate is provided for commonly accommodating said stationary joining pieces, and a joining counter plate is provided for commonly accommodating said corresponding joining counter pieces.

4. A blowing lance media-supply arrangement as set forth in claim 3, further comprising articulation lever means and a pin arranged in the moving direction of said carrying car, and wherein said joining counter plate is arranged parallel to the moving direction of said carrying car and is hinged to said carrying car so as to be pivotable about said pin by means of said articulation lever means.

5. A blowing lance media-supply arrangement as set forth in claim 3, wherein said joining counter plate is arranged on said carrying car so as to be displaceable parallelly to the moving direction of said carrying car.

6. A blowing lance media-supply arrangement as set forth in claim 5, further comprising a coupling piece mounted on said stationary joining plate, said coupling piece overlapping said joining counter plate of said carrying car when it is in said blowing position and having a pressure-medium cylinder, said pressure-medium cylinder engaging said joining counter plate so as to move said joining counter plate transverse to the moving direction of said carrying car, and into and out of closing contact with said stationary joining plate.

7. A blowing lance media-supply arrangement as set forth in claim 3, further comprising at least one supporting wheel provided at said joining counter plate, a rail being arranged parallel to the moving direction of said carrying car, said at least one supporting wheel being supported by said rail.

8. A blowing lance media-supply arrangement as set forth in claim 1 wherein said at least one metallurgical vessel is at least two converters, separate media-supply conduit means lead to the blowing positions of each converter and are each provided with separate stationary joining pieces, said carrying car being displaceable between said stationary joining pieces and being selectively connectable to said stationary joining pieces.

* * * * *